US010697196B2

(12) United States Patent
Nicholson, Jr. et al.

(10) Patent No.: US 10,697,196 B2
(45) Date of Patent: Jun. 30, 2020

(54) SHELTER WITH ADJUSTABLE CANOPY

(71) Applicant: The Coleman Company, Inc., Wichita, KS (US)

(72) Inventors: David A. Nicholson, Jr., Wichita, KS (US); Neil D. Cox, Wichita, KS (US); Thomas G. Trefz, Andover, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 16/351,645

(22) Filed: Mar. 13, 2019

(65) Prior Publication Data

US 2019/0284830 A1 Sep. 19, 2019

Related U.S. Application Data

(60) Provisional application No. 62/642,437, filed on Mar. 13, 2018, provisional application No. 62/711,792, filed on Jul. 30, 2018.

(51) Int. Cl.

| | |
|---|---|
| ***E04H 15/54*** | (2006.01) |
| ***E04H 15/44*** | (2006.01) |
| ***E04H 15/58*** | (2006.01) |
| *E04H 15/50* | (2006.01) |
| *E04H 15/46* | (2006.01) |

(52) U.S. Cl.

CPC ..... *E04H 15/54* (2013.01); *E04H 15/44* (2013.01); *E04H 15/58* (2013.01); *E04H 15/46* (2013.01); *E04H 15/50* (2013.01)

(58) Field of Classification Search

CPC ..... E04H 15/50; E04H 15/54; E04H 15/58

See application file for complete search history.

(56) References Cited

U.S. PATENT DOCUMENTS

| | | | | |
|---|---|---|---|---|
| 3,621,857 | A * | 11/1971 | May et al. | E04H 15/00 135/94 |
| 4,856,436 | A * | 8/1989 | Campbell | E04B 1/94 109/1 R |
| 7,367,348 | B2 * | 5/2008 | Tsai | E04H 15/50 135/122 |
| 7,775,229 | B2 * | 8/2010 | Sy-Facunda | E04H 15/48 135/117 |
| 8,544,489 | B2 * | 10/2013 | Choi | E04H 15/50 135/140 |
| 8,701,692 | B2 * | 4/2014 | Holland | E04H 15/50 135/122 |

(Continued)

*Primary Examiner* — David R Dunn
*Assistant Examiner* — Danielle Jackson
(74) *Attorney, Agent, or Firm* — Husch Blackwell LLP

(57) ABSTRACT

In an example embodiment, A shelter comprises a primary canopy and a frame assembly. The frame assembly includes a plurality of leg members and an upper frame. Each leg member attaches to the upper frame at a respective corner bracket of the upper frame. The primary canopy is attached to the upper frame, which includes at least one roof member extending from each corner bracket. At least one roof member includes a telescoping inner shaft so as to be selectively extendable therefrom. A support member also extends above at least a portion of the at least one roof member to support the primary canopy. A secondary canopy is attached to the telescoping inner shaft for selective deployment therewith.

7 Claims, 10 Drawing Sheets

(56) References Cited

U.S. PATENT DOCUMENTS

| | | | | |
|---|---|---|---|---|
| 8,893,737 | B2 * | 11/2014 | Yang | E04H 15/48 135/121 |
| 9,739,073 | B2 * | 8/2017 | Huang | E04H 15/322 |
| 10,036,179 | B1 * | 7/2018 | Bertuch | E04H 15/58 |
| 10,113,329 | B2 * | 10/2018 | Choi | E04H 15/46 |
| 10,119,297 | B2 * | 11/2018 | Choi | E04H 15/46 |
| 10,280,645 | B1 * | 5/2019 | Yang | E04H 15/50 |
| 10,309,121 | B2 * | 6/2019 | Choi | E04H 15/46 |
| 2007/0051397 | A1 * | 3/2007 | Choi | E04H 15/50 135/131 |
| 2010/0275962 | A1 * | 11/2010 | Park | E04H 15/50 135/122 |
| 2013/0247948 | A1 * | 9/2013 | Lovley | E04H 15/50 135/145 |

* cited by examiner

PRIOR ART

SHELTER WITH ADJUSTABLE CANOPY

CROSS-REFERENCE TO RELATED APPLICATIONS

This application claims the benefit of U.S. Provisional Application No. 62/642,437, filed Mar. 13, 2018 and U.S. Provisional Application 62/711,792, filed Jul. 30, 2018, both of which are hereby incorporated by reference in their entirety.

FIELD OF INVENTION

The present invention relates generally to a shelter or tent. More particularly, the present invention relates to a shelter structure with a selectively deployable secondary canopy to supplement the primary canopy.

BACKGROUND OF INVENTION

Portable shelters and tents are used for numerous activities including camping, sporting events, picnics, beach-going, fairs. Often, such structures are used for their provision of simple shade from the sun and protection from other weather elements. Some conventional shelters must be assembled before and disassembled after each use. However, many conventional shelters are of the "instant" type, in which the frame is comprised of interconnected members, hubs, brackets and hinges so that deployment is relatively quick and easy. The canopy portion of the "instant" shelter can be attached to the frame prior to deployment or can be attached after the shelter is erected.

Although "instant" type shelters are easy to deploy, they typically have a set size when fully deployed. Users therefore have no way to customize their shade area to accommodate events of varying sizes. Several prior art shelters utilize simple shade walls that can swing up or down to offer additional shaded area, while others have the ability only to tilt/angle the shelter itself. There is therefore still a need for adjustable shade coverage from standard and/or "instant" type shelters.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In an example embodiment, a shelter comprises a primary canopy and a frame assembly. The frame assembly includes a plurality of leg members and an upper frame. Each leg member attaches to the upper frame at a respective corner bracket of the upper frame. The primary canopy is attached to the upper frame, which includes at least one roof member extending from each corner bracket. At least one roof member includes a telescoping inner shaft so as to be selectively extendable therefrom. A support member also extends above at least a portion of the at least one roof member to support the primary canopy. A secondary canopy is attached to the telescoping inner shaft for selective deployment therewith.

For a fuller understanding of the nature and advantages of the present invention, reference should be made to the ensuing detailed description and accompanying drawings.

DESCRIPTION OF THE DRAWINGS

For a better understanding of the various embodiments of the present invention, reference may be made to the accompanying drawings in which.

Figure 1:
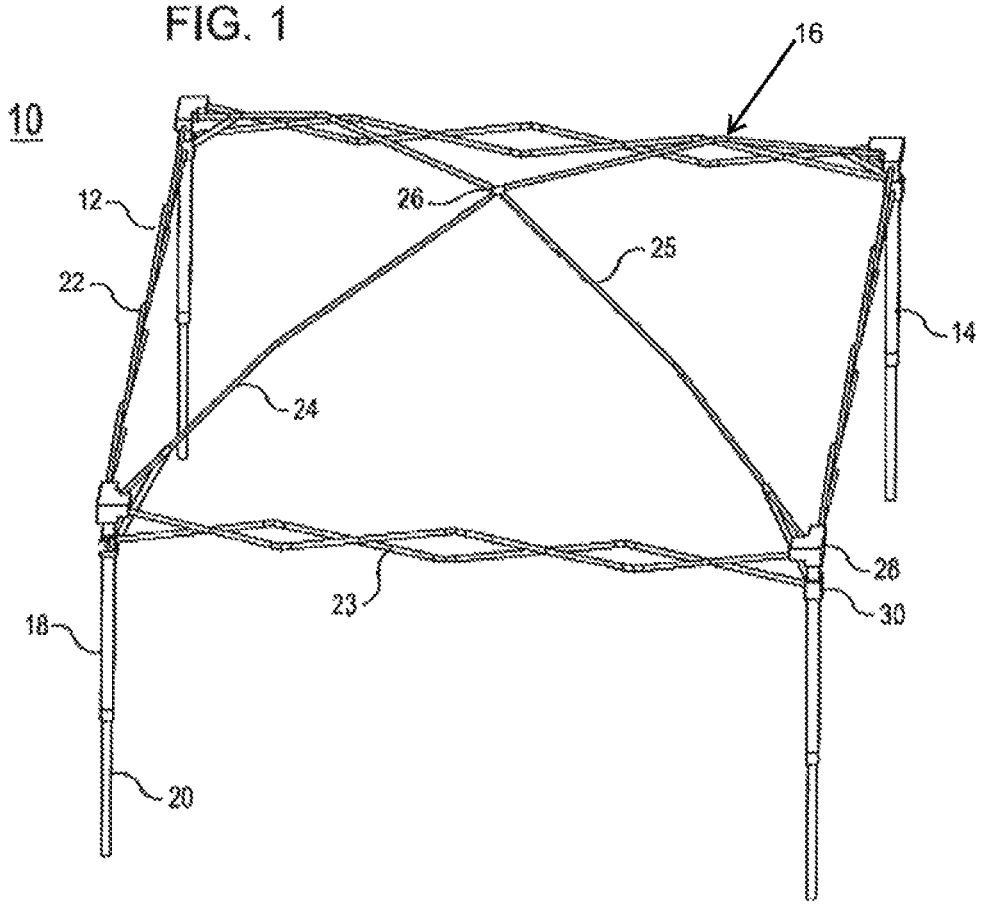
FIG. 1 a perspective view of a frame assembly according to an example embodiment.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

In the following description, various embodiments of the present invention will be described. For purposes of explanation, specific configurations and details are set forth in order to provide a thorough understanding of the embodiments. It will also be apparent to one skilled in the art, however, that the present invention may be practiced without the specific details. Furthermore, well-known features may be omitted or simplified in order not to obscure the embodiment being described.

Referring now to the drawings, in which like reference numerals represent like parts throughout the several views, FIG. 1 shows a prior art "instant" portable shelter 10 that includes a frame assembly 12 and a canopy (not shown). Frame assembly 12 is of a conventional construction and 12 includes leg members 14 and upper frame 16. There are preferably four leg members 14 for supporting a four-sided shelter, each leg member 14 comprising an upper leg 18 telescopically connected to a lower leg 20 to enable the entire frame assembly 12 or portions of the frame assembly 12 to be set at various heights through the use of locking mechanisms (not shown) which are known and used in the industry. Base feet (not shown) are located at the lower end of lower legs 20 to provide a stable foundation for the shelter frame. Upper frame 16 comprises truss assembly 22 which extends between the leg members 14 on each side of the shelter near the top edge and roof assembly 24. As shown in FIG. 1, truss assembly 22 is comprised of multiple individual truss members 23 which are crisscrossed and connected to each other at hinge points to allow for scissor-like folding of the members for deployment and collapsing of the frame. Roof assembly 24 comprises roof members 25 and center hub 26 which are similarly connected to each other at hinge points to allow for expansion and collapsing. Certain of the hinge points are unidirectional hinges which are known in the industry and which allow the frame structure to maintain its desired rigidity. The upper crisscrossed truss members 23 have ends located at each corner of the frame are connected to a corner bracket 28. The lower crisscrossed truss members 23 have ends located at each corner of the frame are connected to a sliding bracket 30 as shown in FIG. 1. The sliding bracket 30 comprises a locking sleeve that can move vertically along the upper leg 18 to allow for adjustment of the frame height. The foregoing description of the shelter frame construction is not intended to limit the scope of the present invention but is intended only to provide a general description of "instant" type shelters that are known in the industry such as the structure disclosed in U.S. Pat. No. 5,632,293 and similar patents. Other frame constructions known and used in the industry can also be utilized with the present invention.

Figure 2:
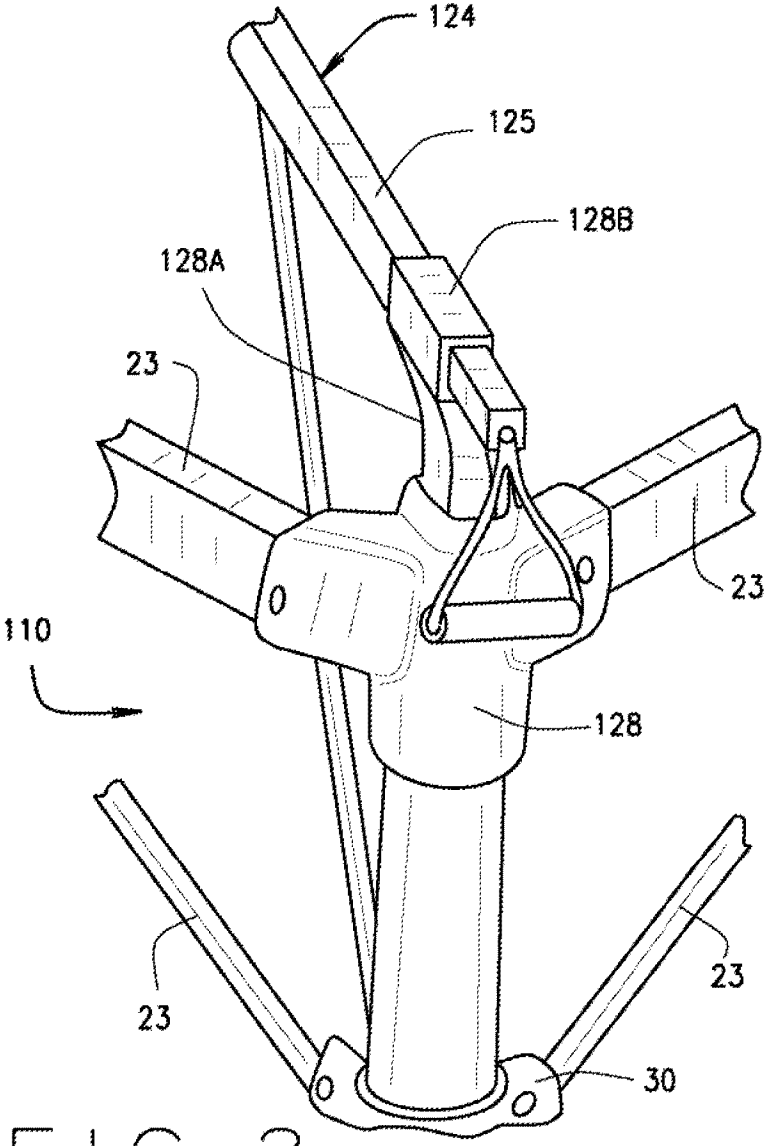
FIG. 2 is a perspective view of a corner bracket in a deployed position according to an example embodiment.

FIG. 2 illustrates a modified roof assembly 124 and a modified corner bracket 128, according to an example embodiment of a modified shelter 110. As can be seen in FIG. 2, the lower crisscrossed truss members 23 still engage with a sliding bracket 30, as discussed above. The upper crisscrossed truss members 23 similarly engage with the corner bracket 128 as discussed above. However, the corner bracket 128 engages with the modified roof assembly 124 differently than as discussed above. An elevated neck 128A extends from the top of the corner bracket 128, to a collar 128B. The collar 128B includes a through-hole through which a roof member 125 of the roof assembly 124 extends. Other structures for collar 128B are also envisioned without an actual through-hole, such as a cradle or the like. The corner bracket 128 thereby holds the roof member 125 such that the longitudinal axis of the roof member 125 in an elevated position relative to the roof member 25 in FIG. 1.

Figure 3:
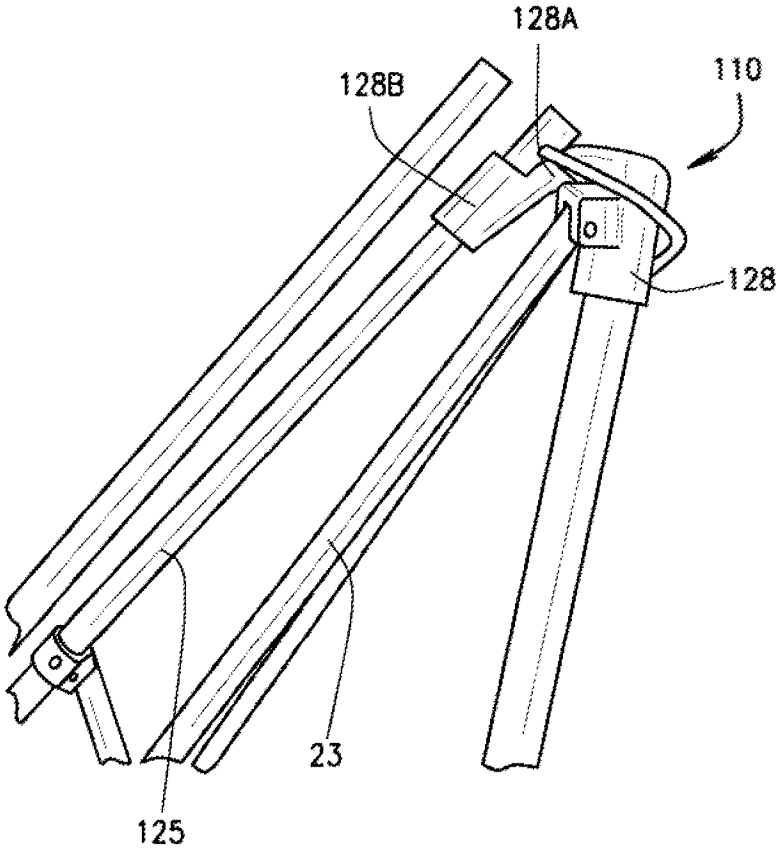
FIG. 3 is a perspective view of a corner bracket moving to a storage position according to an example embodiment.

As is shown in FIG. 3, the elevated neck 128A is preferably hinged to allow for collapse of the shelter 110. As the shelter 110 collapses, largely as discussed above in connection with FIG. 1, the roof member 125 moves from an inclined position (as shown in FIG. 2) to a declined position (as shown in FIG. 3). The elevated neck 128A pivots about its hinge to allow this change in position and orientation of the roof member 125, again as shown in FIG. 3. Alternatively, elevated neck 128A may simply be made from an elastically deformable material, such as in a living hinge.

Figure 4:
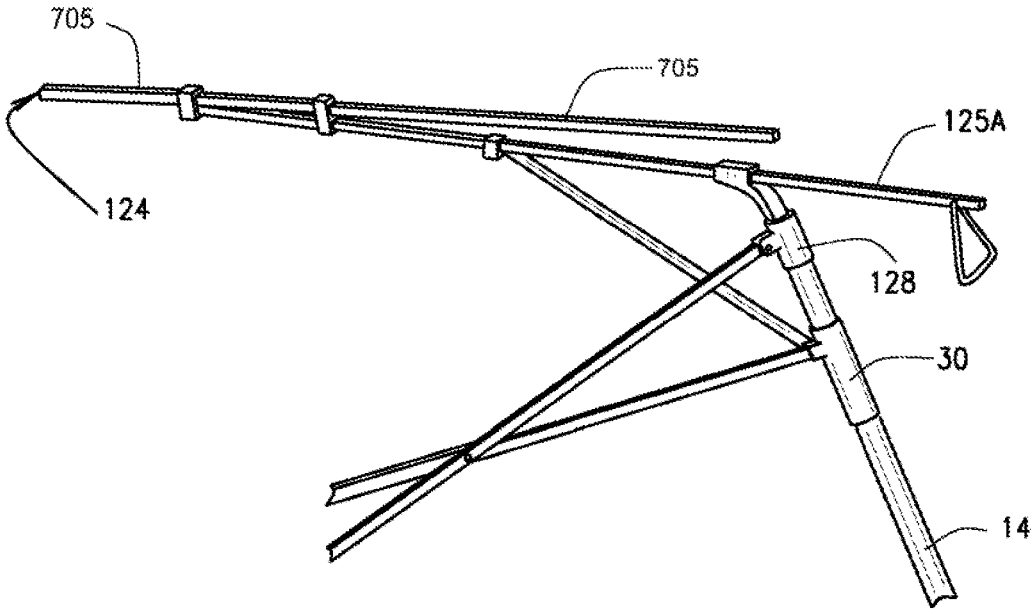
FIG. 4 is a perspective view of a portion of a frame assembly in which an inner shaft is partially extended from its roof member, according to an example embodiment.
Figure 5:
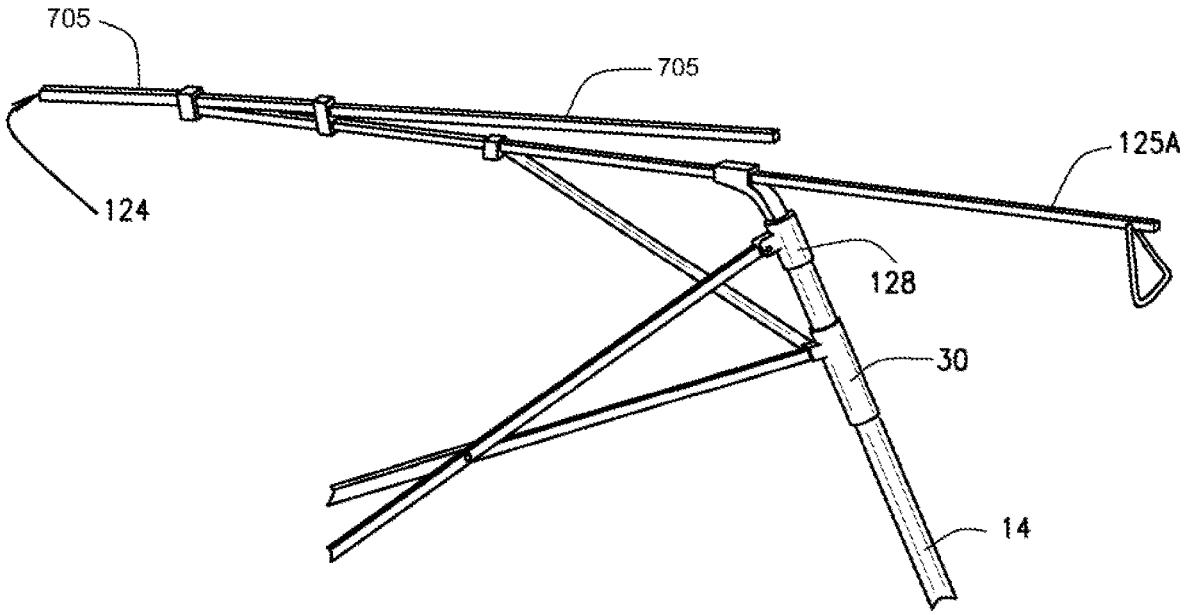
FIG. 5 is a perspective view of a portion of a frame assembly in which an inner shaft is fully extended from its roof member, according to an example embodiment.

A selectively extendable inner shaft 125A is positioned within the roof member 125 engaged by the corner bracket 128. By elevating the longitudinal axis of the roof member 125 above the location of a prior art corner bracket 28, and by allowing the roof member 125 to pass through the through-hole of the collar 128B, the inner shaft 125A is permitted to extend from or retract into the roof member 125. A partially and fully extended inner shaft 125A is shown in FIGS. 4 and 5, respectively.

Figure 6:
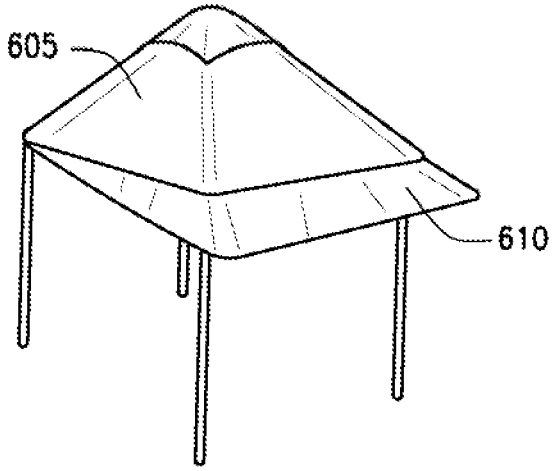
FIG. 6 is a perspective view of a shelter with its secondary canopy extended at two corners, according to an example embodiment.

Thus, in addition to the main canopy 605 shown in FIG. 6, a secondary canopy 610 may be provided. The secondary canopy 610 may be affixed to a distal end of each inner shaft 125A. As each secondary shaft 125A is selectively telescoped out from its respective roof member 125, the secondary canopy 610 may similarly be extended out from underneath the primary canopy 605, as shown in FIG. 6. Similarly, retraction of each inner shaft 125A results in withdrawal of the secondary canopy 610 back beneath the primary canopy 605. Extension or retraction of each inner shaft 125A may occur independently of any others, as shown in FIG. 6 in which two inner shafts 125A are extended while the other two are fully retracted. The secondary canopy 610 can thereby be extended or retracted in a shape as needed by the user.

Figure 7:
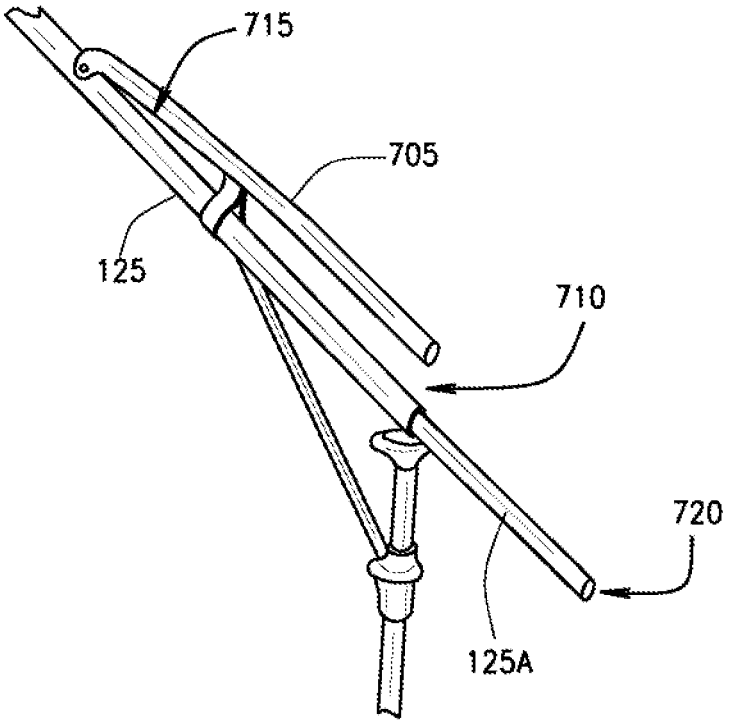
FIG. 7 is a perspective view of a portion of a frame assembly illustrating the support member in addition to its associated roof member, according to an example embodiment.

As will be appreciated, in prior art shelter structures, the primary—and often only—canopy 605 is affixed to the roof member 25 proximate the corner bracket 28. The primary canopy 605 is thereby supported directly on the roof member 25. However, as is seen in FIG. 7, a support member 705 is employed extending above the roof member 125. The primary canopy 605 extends overtop of and is supported by the support member 705 instead the roof member 125. The gap 710 between the support member 705 and the roof member 125 provides space for the secondary canopy 610, which may be affixed to the roof member 125 below the support member 705 proximate the vertex 715 therebetween. The secondary canopy 610 may also be affixed to the distal end 720 of the inner shaft 125A. In an alternative embodiment, the primary canopy 605 may be positioned directly on the roof member 125, while the secondary canopy 610 is stored below the roof member 125 when not deployed.

FIG. 7 shows an embodiment in which a support member 705 extends upwardly from the otherwise in-line roof member 125. However, in FIGS. 4 and 5, the support member 705 is actually substantially in line with the roof member 125 from which it extends, and the roof member 125 actually extends somewhat downwardly therefrom.

The secondary canopy 610 may be composed of various materials. In an example embodiment, the secondary canopy 610 may be made from a stretchy or otherwise resiliently deformable material. In such an embodiment, when the inner shaft 125A is extended, the increased distance between the vertex 715 and the distal end of the inner shaft 125A causes the secondary canopy 610 to stretch out from underneath the primary canopy 605. Retraction of the inner shaft 125A back into the roof member 125 similarly allows the secondary canopy 610 to elastically retract back under the primary canopy 605.

In an alternate embodiment, the secondary canopy 610 may be made of substantially inelastic materials. In its extended position, the secondary canopy 610 covers a greater area than when it is in its retracted position. Therefore, in such an embodiment, the secondary canopy 610 in its retracted position may be folded, rolled, or otherwise bunched beneath the primary canopy 605. For example, one or more elastic cords may extend between adjacent inner shafts 125A through at least one of the bottom or top of the secondary canopy 610 extending therebetween. When the inner shafts 125A are retracted, the elastic cord may be substantially slack, with the secondary canopy 610 being bunched therealong. Extending one or more inner shafts 125A thereby causes the elastic cord to stretch and the secondary canopy 610 to unfurl toward its extended position. The secondary canopy 610, when inelastic, may instead or also be attached to one or more of the inner shafts 125A by one or more elastic cords extending from such an inner shaft 125A to a corner of the secondary canopy 610. Extending the inner shafts 125A may thereby cause the secondary canopy 610 to extend, and may cause any such elastic cords to stretch.

Each inner shaft 125A may be locked in place using structures and techniques know to those in the art. For example, a simple pin or detent may be used to secure an inner shaft 125A in either a fully retracted or fully extended position, or in between. In an example embodiment, a spring button or pin may be used, such that a pin is positioned on a rocker arm. The pin or detent or similar known structure may be actuated via a handle or button or the like, to allow for selective movement thereof. In an example embodiment, pulling a handle associated with an inner shaft 125A may both unlock the inner shaft 125A for movement, and may control the actual movement thereof. In another embodiment, a button may be depressed when unlocking the inner shaft 125A is desired, and a separate handle may then be used to control such movement. Other structures are also envisioned for these purposes.

Figure 8:
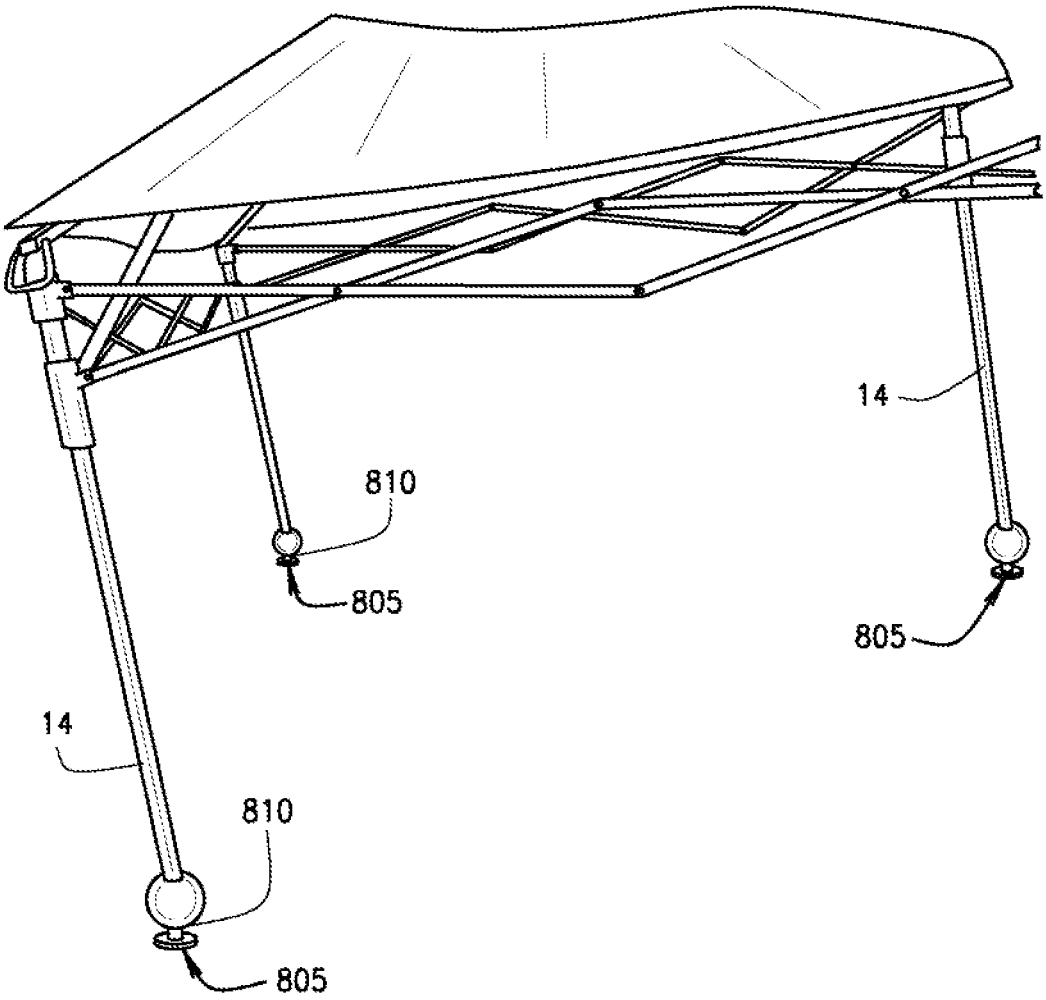
FIG. 8 is a perspective view of a portion of a frame assembly illustrating a tilted arrangement, according to an example embodiment.
Figure 9:
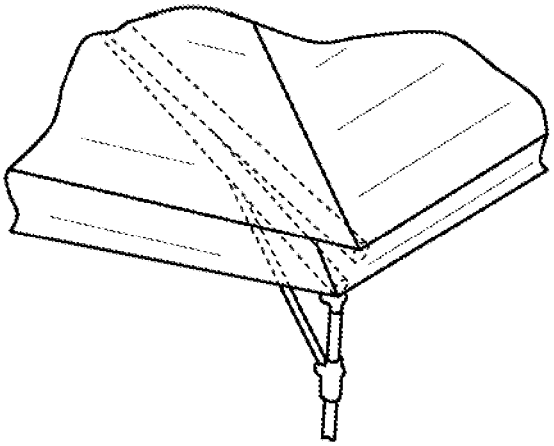
FIG. 9 is a perspective view of a portion of a shelter in which the secondary canopy is not deployed, according to an example embodiment.
Figure 10:
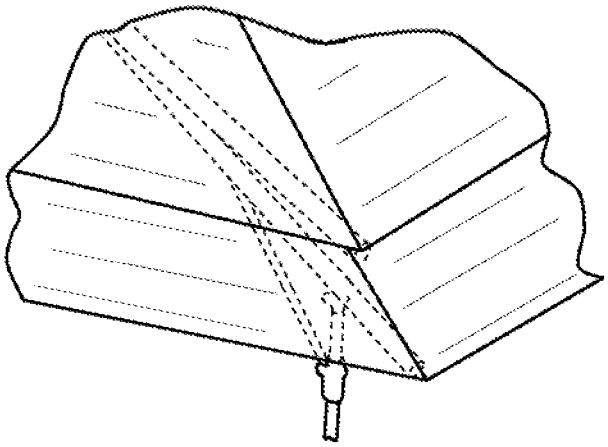
FIG. 10 is a perspective view of a portion of a shelter in which the secondary canopy deployed, according to an example embodiment.
Figure 11:
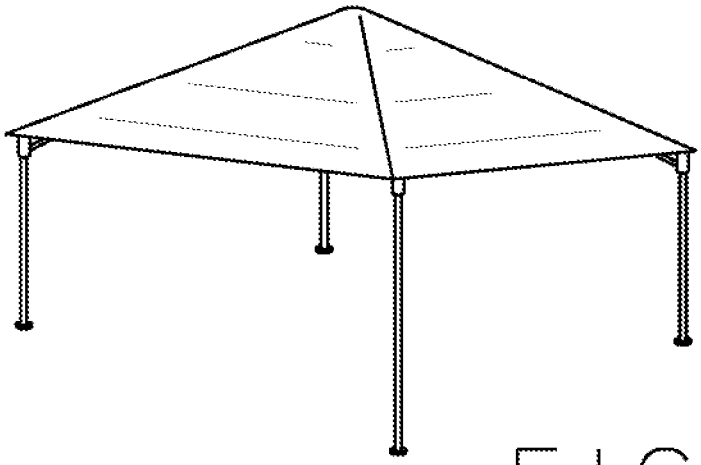
FIGS. 11-16 are perspective views of a shelter with its secondary canopy deployed into various configurations, according to an example embodiment.
Figure 12:
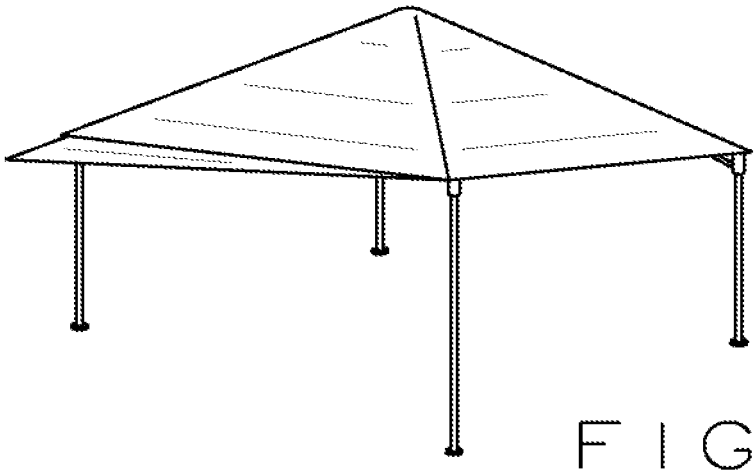
Figure 13:
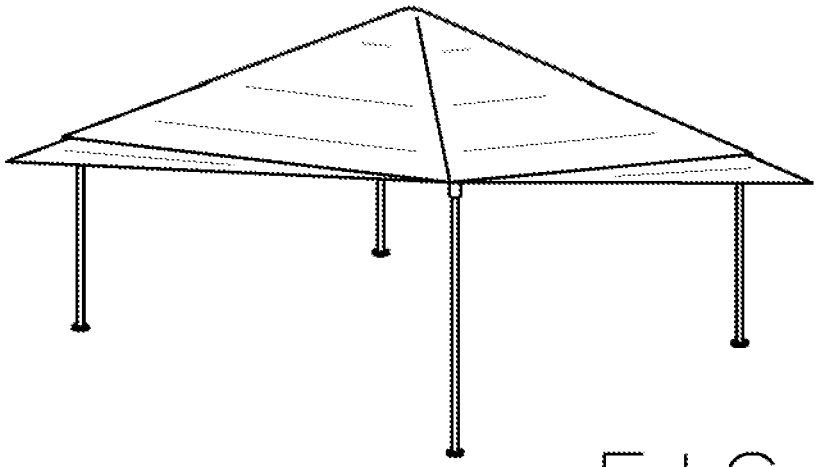
Figure 14:
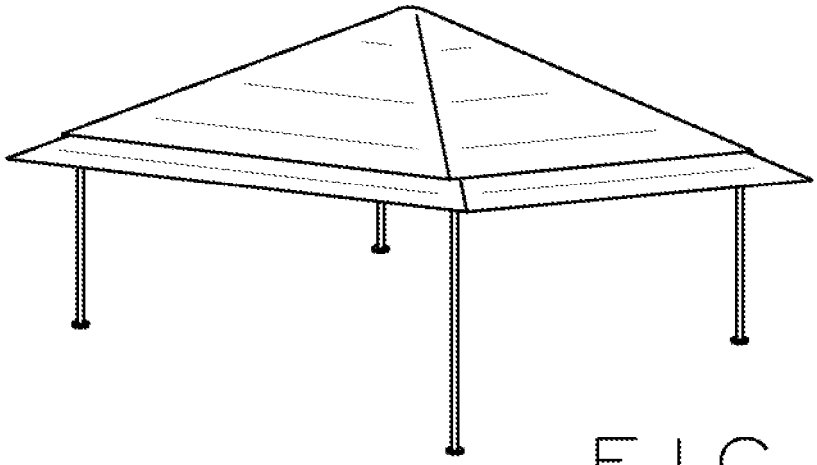
Figure 15:
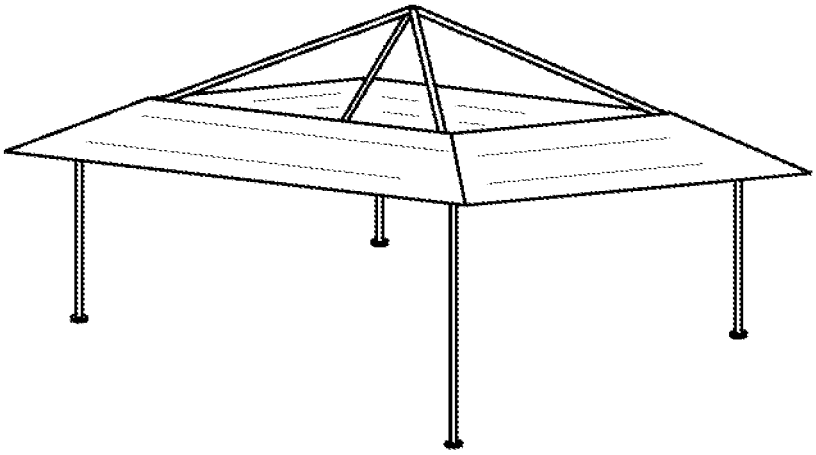
Figure 16:
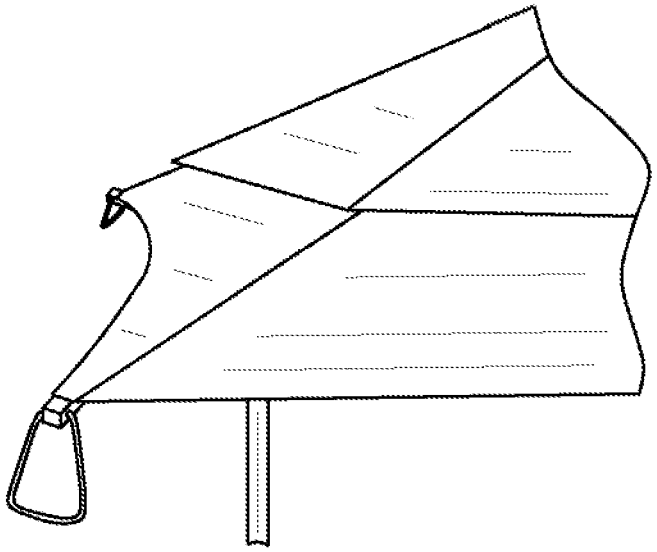

Other structures are also envisioned for achieving similar adjustable characteristics of a shelter. For example, inner shafts 125A may extend from the edges of the structure 110 rather than from the corners of the structure 110. In such an example, roof members 125 or the like may be side-mounted instead of or in addition to corner-mounted. Alternatively, the secondary canopy 610 may be extended via other mechanisms along the sides of the shelter 110 and its primary canopy 605. In addition, as shown in FIG. 8, base feet 805 of the shelter 110 may include a ball joint 810 which allows a stake pad to be in maximum contact with the surface upon which the shelter 110 is assembled. For example, in FIG. 8, the shelter 110 is deployed at an angle by setting leg members 14 to different heights. Ball joints 810 in the base feet 805 allow the stake pads to nevertheless rest evenly on the ground. Base feet 805 may alternatively be socket joint feet, dish feet, slant feet, or swivel feet, or the like. As will be understood, these base foot 805 embodiments may be appropriate given the shelter's ability to adjust the length of individual leg members 14.

Alternatively or in addition, a kick out design may be employed. In such a structure, telescoping inner shafts 125A may not be used. Instead, such a shelter may include additional canopy material in one or more corners or along one or more sides. Such additional canopy material may be unfolded and held in place via a support pole/rod. In another embodiment, additional expansion sections could be incorporated into the scissoring frame assembly 12, etc.

Figure 17:
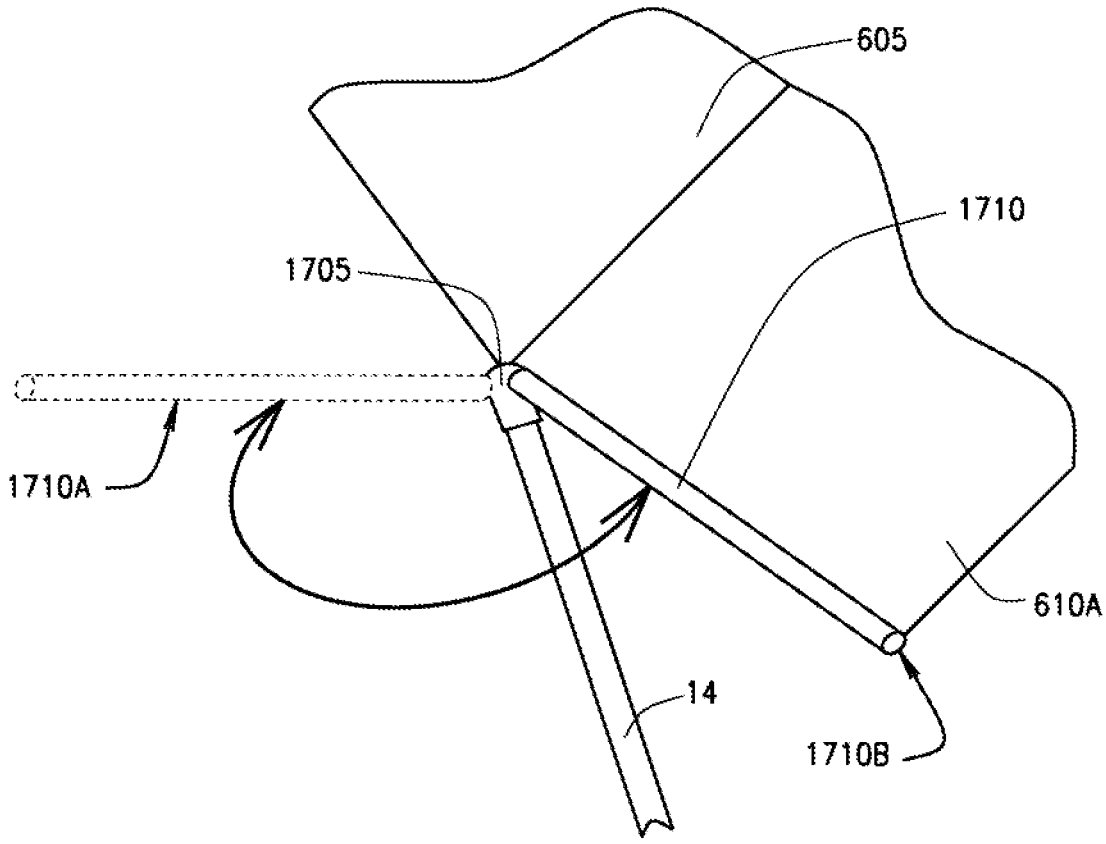
FIG. 17 is a perspective view of an alternative embodiment of a portion of a frame assembly illustrating a different embodiment of an extendable canopy that swings out, according to an example embodiment.

As a non-limiting example, FIG. 17 illustrates an alternative embodiment in which a leg member 14 extends up to a modified bracket 1705. The modified bracket 1705 is rotatably engaged with a secondary canopy shaft 1710, such that the secondary canopy shaft 1710 can rotate about the longitudinal axis of the leg member 14 from a retracted position 1710A to an extended position 1710B. In the retracted position 1710A, a secondary canopy shaft 1710 is positioned under or nearly under the main canopy 605, such that the secondary canopy 610A remains retracted. However, in the extended position 1710B, a secondary canopy shaft 1710 extends out from the modified bracket 1705, such that the secondary canopy 610A is also extended from underneath the main canopy 605.

Figure 18:
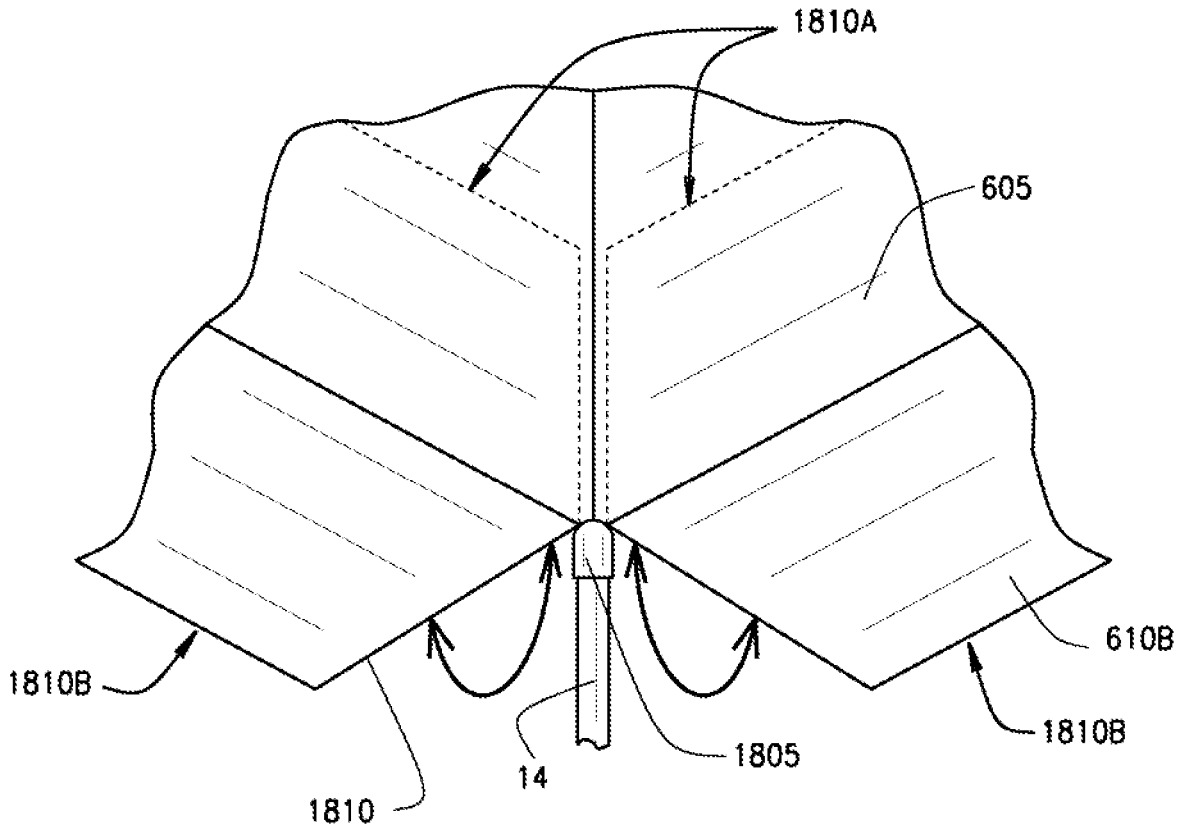
FIG. 18 is a perspective view of another alternative embodiment of a portion of a frame assembly illustrating a different embodiment of an extendable canopy that folds out, according to an example embodiment.

FIG. 18 illustrates another alternative embodiment in which a leg member 14 extends up to a modified bracket 1805. The modified bracket 1805 is again rotatably engaged with a secondary canopy shaft 1810, such that the secondary canopy shaft 1810 can rotate about an axis that is perpendicular to the longitudinal axis of the leg member 14, from a retracted position 1810A to an extended position 1810B. In the retracted position 1810A, a secondary canopy shaft 1810 is positioned under or nearly under the main canopy 605, such that the secondary canopy 610B remains retracted. However, in the extended position 1810B, a secondary canopy shaft 1810 extends out from the modified bracket 1805, such that the secondary canopy 610B is also extended from underneath the main canopy 605.

Figure 19:
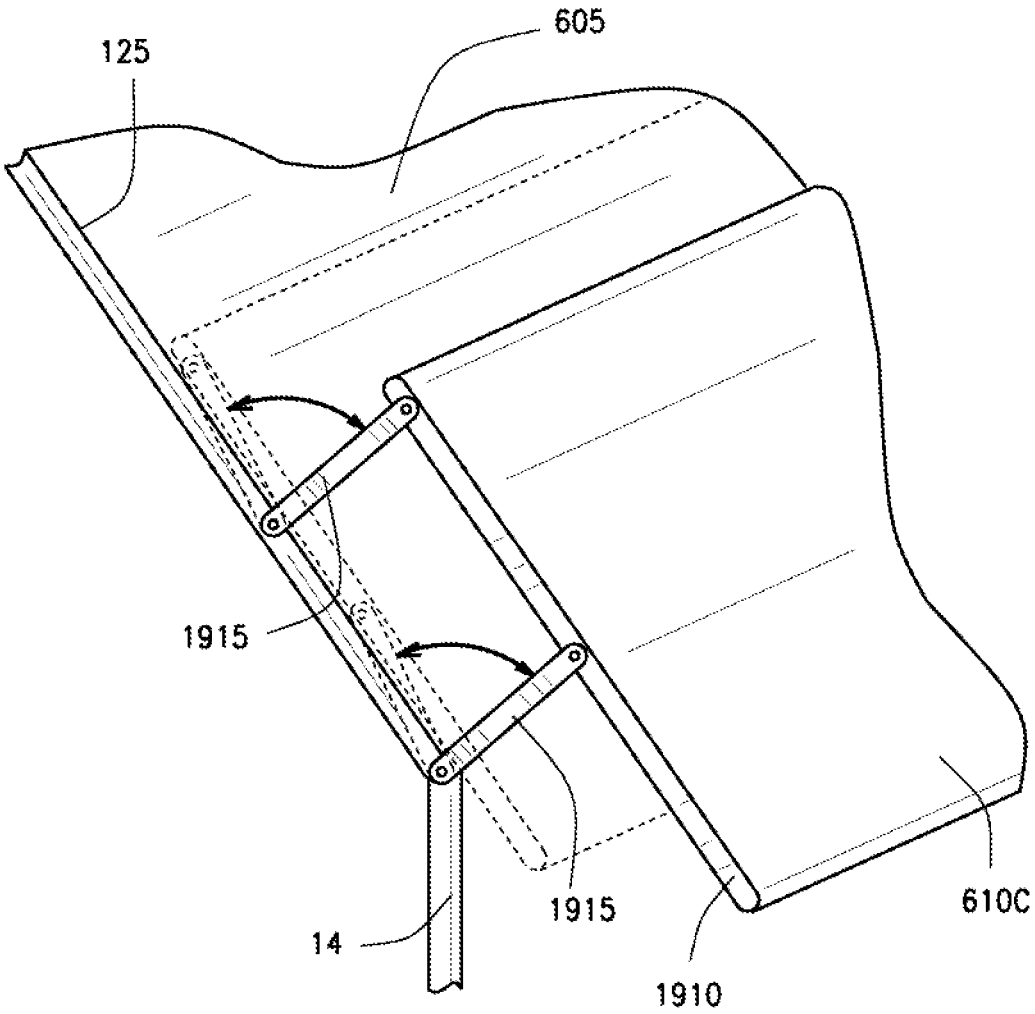
FIG. 19 is a perspective view of another alternative embodiment of a portion of a frame assembly illustrating a different embodiment of an extendable canopy that pops out, according to an example embodiment.

FIG. 19 illustrates another alternative embodiment in which a secondary canopy 610C extends along a secondary canopy shaft 1910. The secondary canopy shaft 1910 is connected to a roof member 125 via one or more adjustment arms 1915. The one or more adjustment arms 1915 are rotatably engaged with both the roof member 125 and the secondary canopy shaft 1910 to allow extension or retraction of the secondary canopy 610C. The secondary canopy 610C may extend in a plane that is generally parallel with the plane of its corresponding section of the main canopy 605 during extension or retraction, due to the placement and movement of the adjustment arms 1915. As such, the secondary canopy 610C pops up—or down—from the main canopy 605 during extension, before being fully positioned in its extended state.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shelter comprising:

a primary canopy having an outer edge;

a frame assembly including a plurality of leg members and an upper frame, wherein each leg member attaches to said upper frame at a respective corner bracket of the upper frame, and wherein the primary canopy is attached to the upper frame extends to said corner brackets, the upper frame including:

at least one roof member extending from a said corner bracket;

a telescoping inner shaft within a said at least one roof member so as to be selectively extendable therefrom from a first position to a second position; and a support member extending above at least a portion of the said at least one roof member to support the primary canopy; and a secondary canopy attached to the telescoping inner shaft for selective deployment therewith;

wherein in the first position, the secondary canopy is retracted; and wherein in the second position, the secondary canopy extends at least partially beyond the outer edge of the first canopy.

2. The shelter of claim 1 wherein each corner bracket includes an elevated neck extending to a collar, and wherein a roof member is received through a through-hole of the collar.

3. The shelter of claim 2 wherein the elevated neck of the corner bracket is elastically deformable to allow folding of the shelter.

4. The shelter of claim 1 wherein the secondary canopy is positioned between the support member and its respective roof member when the secondary canopy is not deployed.

5. The shelter of claim 1 wherein the secondary canopy is composed of a stretchy material, such that deployment of the telescoping inner shaft, and thereby of the secondary canopy, results in elastic stretching of the secondary canopy.

6. The shelter of claim 1 wherein at least one of the plurality of leg members includes a telescoping member to selectively adjust in height.

7. The shelter of claim 6 wherein the at least one of the plurality of leg members is attached to a base via a ball and socket joint.

* * * * *